US005172529A

United States Patent [19]

Van De Riet

[11] Patent Number: 5,172,529

[45] Date of Patent: Dec. 22, 1992

[54] HINGED WIRE MANAGEMENT COVER PANEL

[75] Inventor: Douglas M. Van De Riet, Holland, Mich.

[73] Assignee: Herman Miller, Inc., Zeeland, Mich.

[21] Appl. No.: 643,426

[22] Filed: Jan. 22, 1991

[51] Int. Cl.[5] ..... E04B 5/48

[52] U.S. Cl. ..... 52/221; 52/238.1; 52/239; 52/36; 16/392; 108/134

[58] Field of Search ..... 52/221, 238.1, 239, 52/242, 243, 243.1, 36, 37; 16/392, 391, 390; 108/134, 135, 50; 312/223, 194

[56] References Cited

U.S. PATENT DOCUMENTS

| | | | |
|---|---|---|---|
| 1,953,562 | 4/1934 | Lansing | 108/135 |
| 2,568,686 | 9/1951 | Peter | 108/135 |
| 3,166,285 | 1/1965 | Downes | 52/36 X |
| 3,604,154 | 9/1971 | Curran | 16/389 X |
| 4,161,850 | 7/1979 | Peterson et al. | 16/392 X |
| 4,372,629 | 2/1983 | Propst et al. | 312/223 |
| 4,437,839 | 3/1984 | Stempel | 108/134 X |
| 4,535,577 | 8/1985 | Tenser et al. | 52/238 |
| 4,685,255 | 8/1987 | Kelley | 52/36 |
| 4,731,960 | 3/1988 | Sease | 52/36 |
| 4,762,072 | 8/1988 | Boundey et al. | 52/242 X |
| 4,876,835 | 10/1989 | Kelley et al. | 52/238.1 X |
| 4,899,510 | 2/1990 | Propst | 52/238.1 |

FOREIGN PATENT DOCUMENTS

| | | | |
|---|---|---|---|
| 199814 | 3/1958 | Austria | 108/135 |
| 120785 | 2/1948 | Sweden | 108/135 |

OTHER PUBLICATIONS

Teknion Catalog: Modular Power Panels, p. 8, 1983 publication.

*Primary Examiner*—David A. Scherbel
*Assistant Examiner*—Kien Nguyen
*Attorney, Agent, or Firm*—Varnum, Riddering, Schmidt & Howlett

[57] ABSTRACT

A panel (12) is mounted to a partition (10) by a hinge (50). The panel (12) includes a support member (118) which is pivotably mounted to a bracket (102) on the panel (12). The support member (118) includes a pedestal (120) which is adapted to engage the partition (10) to hold the panel (12) in an open position.

15 Claims, 3 Drawing Sheets

HINGED WIRE MANAGEMENT COVER PANEL

BACKGROUND OF THE INVENTION

1. Field of the Invention

This invention relates generally to office furniture systems and more particularly to a hinged panel forming a part of the office furniture system. In one of its aspects, the invention relates to a hinged panel which is capable of being supported in an open position by a support stand which extends from the hinged panel to a lower panel or support surface forming part of the wall panel structure.

2. Description of the Related Art

Office furniture systems such as that disclosed in Kelley, U.S. Pat. No. 4,685,255 typically utilize a number of wall panel structures having communication and power wiring disposed therein for purposes of providing power and telecommunications hookups at individual work stations within the overall office furniture system. It is well known in the art that easy access to these telecommunication and power cables is needed for maintenance purposes once the office furniture system is put in use.

An easy method of providing access to such telecommunication and power cables is to position the cables or wires behind a hinged panel (e.g., at waistline level) which is capable of being raised for gaining access to the wiring or cabling disposed behind the hinged panel. Such hinged panels are often placed a few feet above the floor for providing easy access to telecommunications and electrical cabling at a convenient height. For example, the Kelley patent discloses a movable panel (FIG. 5) having a hooked clip which engages a slot in the panel support structure and a spring clip which engages a retainer spring mounted to the wall support structure. The hooked clip is positioned near a bottom portion of the panel and the spring clip is positioned at an upper portion of the panel. The Kelley patent also discloses a wire management panel positioned near the bottom of the wall panel structure. This panel is shown in FIG. 4 of the Kelley patent and comprises a hinged cover 82 having an inwardly directed flange 86 and a downwardly-extending projection **86*a* which is snap-fit with a retainer 92 for holding the hinged cover 82** in place.

Tenser et al., U.S. Pat. No. 4,535,577 discloses a wire management panel mounted to a steel frame of a wall panel support structure by clips extending downwardly beneath a lower portion of the panel, and by clips extending upwardly from an upper portion of the panel. The clips fit behind frame portions of the steel support structure. A sealing lip 32 extends between a lower portion of the wire management panel and the upper portion of a decorative panel disposed below the wire management panel. The sealing lip 32 provides a flexible closure, wherein a wire can pass between the wire management panel and the lower decorative wall panel. The Tenser et al. patent also discloses in FIGS. 8 and 10 a hinge 253 for securing the decorative panel 252 to an upper support member 254.

Propst et al., U.S. Pat. No. 4,372,629 discloses a hingedly mounted wire cover 22 (FIG. 3) for a desk which includes a wire brush 40 having a plurality of bristles extending from the cover to the desk to permit wires to pass therethrough.

It is known to provide a panel hinged to a frame in a modular wall system wherein the hinges include springs to bias the panel to a closed position. However, it has become apparent that there is a need to occasionally hold a wire management cover panel (sometimes called a "tile") in an open position to facilitate access to the wire management system. Hinged panels of the prior art must be held open manually to gain such access. With this need in mind, the present inventor has discovered that such a hinged panel can be provided with structure to enable the panel to be retained in an open position without manually holding it.

SUMMARY OF THE INVENTION

According to the invention, a panel is provided for covering a wire raceway in a modular wall structure. The panel comprises a surface having a first edge, a second edge, and opposite side edges extending between the first and second edges. A hinge is mounted on the surface adjacent the first edge for hingedly mounting the panel to the wall structure. Thus, the panel is moveable between a closed position where the surface encloses the wire raceway, and an open position where the wire raceway is exposed. The panel also includes a support member pivotably mounted to the surface for movement between a retained position and an engaging position. The support member has a pedestal which is adapted to engage the wall structure to maintain the panel in the open position when the support member is in the engaging position.

Preferably, the support member is pivotably mounted to a bracket disposed on the surface of the panel away from the first edge. The support member comprises an elongated shaft having an arm extending at a predetermined angle from the shaft. The bracket has a shackle which is disposed at the same angle relative to the second edge. The arm is received in the shackle so that when it is pivoted to the retained position, the shaft is substantially parallel to the second edge.

In one aspect of the invention, the pedestal has an indentation. In another aspect of the invention, the panel comprises a retaining clip on the surface which is adapted to receive and maintain the support member in the retaining position.

Preferably, the panel includes a stop to limit movement of the support member beyond the engaging position. Preferably, the stop is a pin extending from the support member and adapted to abut the surface when the support member is in the engaging position.

In another aspect of the invention, an improvement is provided in a panel for covering a wire raceway in the partition of a modular office divider system. The wire raceway typically extends horizontally between the edges of the partition and the panel is typically pivotally mounted to the partition for movement between a closed position enclosing the wire raceway and an open position exposing the wire raceway. The improvement comprises a prop mounted to the panel with the prop being adapted to maintain the panel in the open position. Preferably, the prop comprises a support member pivotably mounted to the panel for movement between a retained position and an engaging position. The support member has a pedestal adapted to engage the partition to maintain the panel in the open position when the support member is in the engaging position.

Typically, the panel is mounted to the partition by means of a hinge. Preferably, the hinge comprises a mounting plate which is securely fixed to the partition. An L-shaped member extends perpendicularly from the mounting plate and the L-shaped member has a first aperture. A clip is provided which has two spaced legs and a web connecting the legs. The web has nonparallel sides, and the legs extend substantially perpendicularly from the nonparallel sides. One of the legs is securely mounted to a flange on the panel, and the other of the legs is securely mounted to an adjacent surface of the panel. The web has a second aperture. In this construction of the hinge, the first aperture and the second aperture are in registry, and a pin extends through the first and second apertures so that the panel can be pivoted relative to the partition about the pin.

In yet another aspect of the invention, a bearing is disposed between the L-shaped member and the web of the hinge. Preferably, the bearing is a polymer washer. Also, in a preferred embodiment, the pin comprises a plastic expandable bolt which is elastically deformed.

It will thus be seen that the present invention meets the existing need for providing a structure to maintain a hinged panel on a partition in an office furniture system having electrical wire management capability in an open position for easy access to the wire management components.

BRIEF DESCRIPTION OF THE DRAWINGS

The invention will be described with reference to the drawings in which.

DETAILED DESCRIPTION OF THE PREFERRED EMBODIMENTS

It is well known in the prior art that a hinged panel can be used as part of a wall panel structure in an office furniture system especially to cover wire raceways, thereby providing easy access to telecommunication and power components. However, a hinged panel 12 of the present invention enjoys an advantage over the prior art hinged panels because it includes a novel hinge 50 and a support stand assembly 30 acting as a pedestal for holding the panel 12 in an open position. In the following description of the preferred embodiments, the hinged panel will be described with reference to a wall panel structure. However, the invention is understood to have a somewhat broader application, since it can be used in connection with other structures within an office furniture system. For example, the hinged panel 12 could be used with a desk and could be mounted so that when closed, the hinged panel 12 would be flush with a top surface of the desk.

Figure 1:
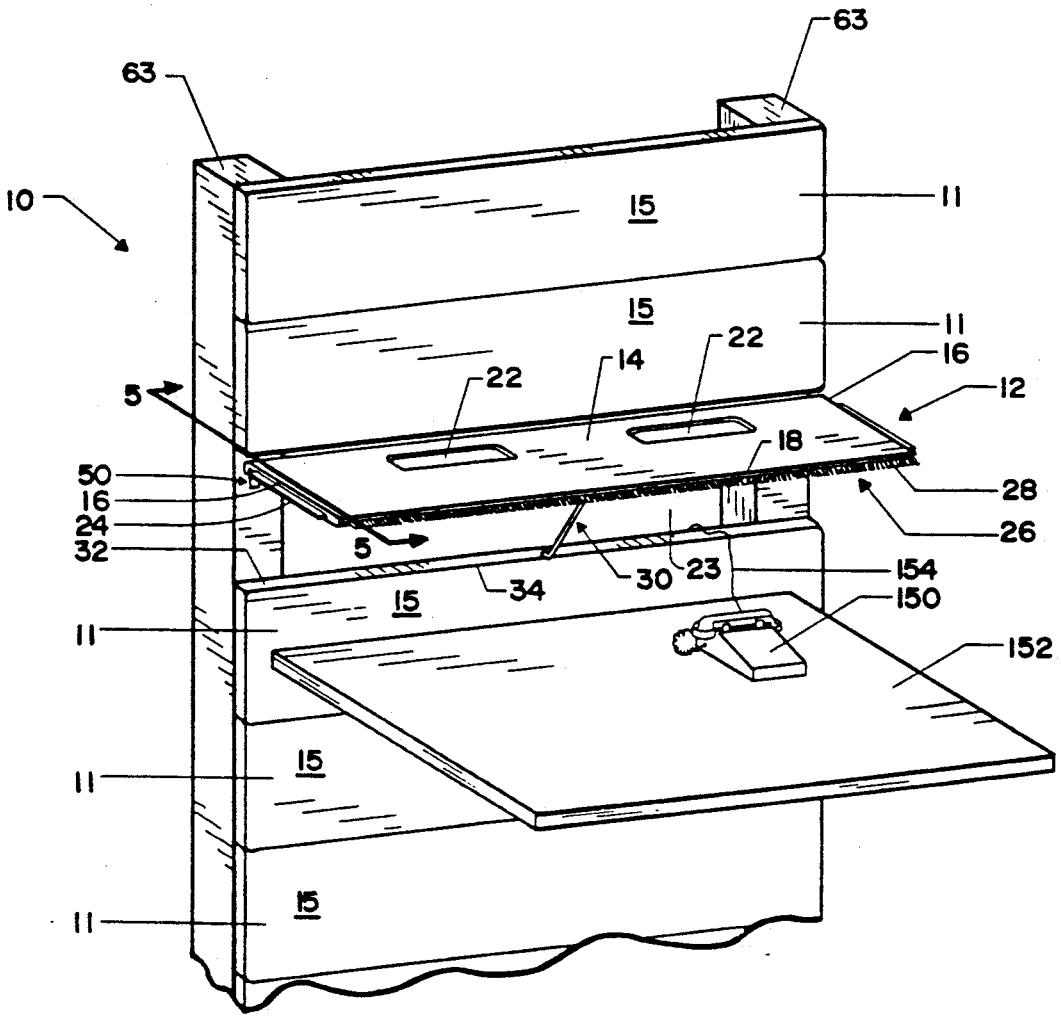
FIG. 1 is a perspective view of a hinged panel used in connection with a wall panel structure, wherein the hinged panel is supported in an open position.

Referring to FIG. 1, an office furniture system 10 comprises decorative wall panels 11 (which can be modular) with the hinged panel 12 placed between the panels 11. The hinged panel 12 is generally rectangular and has a top 14, two sides 16 and a bottom 18. Mounted to each side 16 are long and slender wipers 24 which have a flexible construction. The wipers 24 are preferably formed of a thermosetting rubber. Mounted to the bottom 18 of the hinged panel 12 is a brush 26 having bristles 28. The hinged panel 12 includes two openings 22 which permit access to electrical components when the hinged panel is in a closed position. For example, electrical outlets (not shown) can be disposed in a wire management channel 23 in position to be aligned with the openings 22 when the hinged panel 12 is in the closed position in a manner disclosed by U.S. Pat. No. 4,685,255 to Kelley which is incorporated herein by reference. Thus, electrical plugs can be inserted into the electrical outlets by a user of the office furniture system 10 even when the hinged panel 12 is in the closed position. The hinged panel 12 further comprises the support stand assembly 30 which is used to support the hinged panel 12 in the open position when one needs to gain access to the wire management channel 23.

Figure 2:
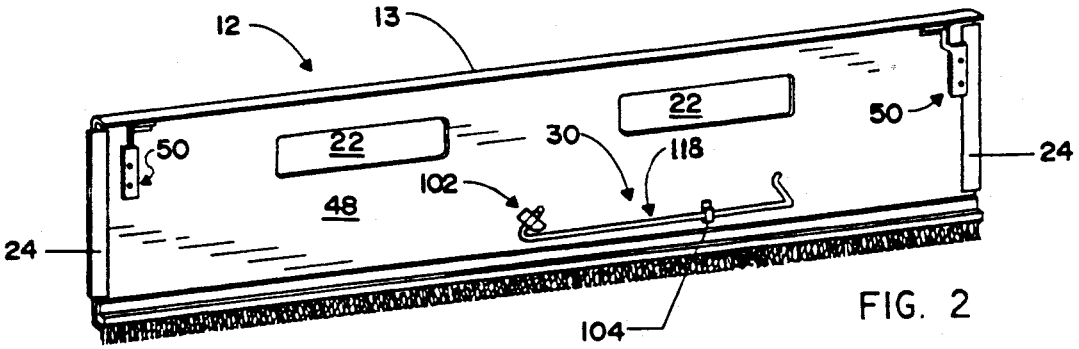
FIG. 2 is a perspective view of a back surface of the hinged panel of FIG. 1.

Referring to FIG. 2, a back surface 48 of the hinged panel 12 has two hinges 50 mounted near the wipers 24 and adjacent the top 14 of the hinged panel 12. The structure of the hinge 50 is explained in further detail below. Also mounted on the back surface 48 of the hinged panel 12 is the support stand assembly 30. The support stand assembly 30 will also be described in further detail below.

Figure 3:
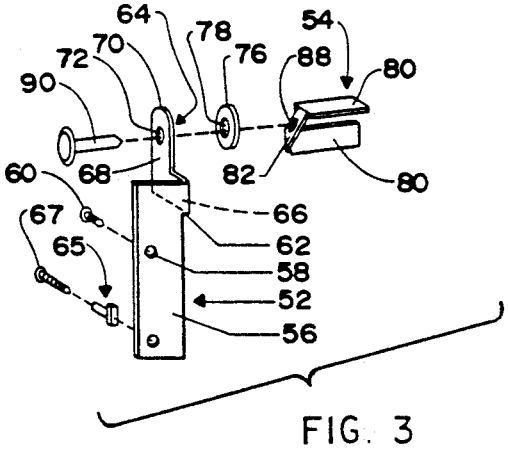
FIG. 3 is an enlarged, exploded, perspective view of a hinge assembly which forms a part of the hinged panel.
Figure 5:
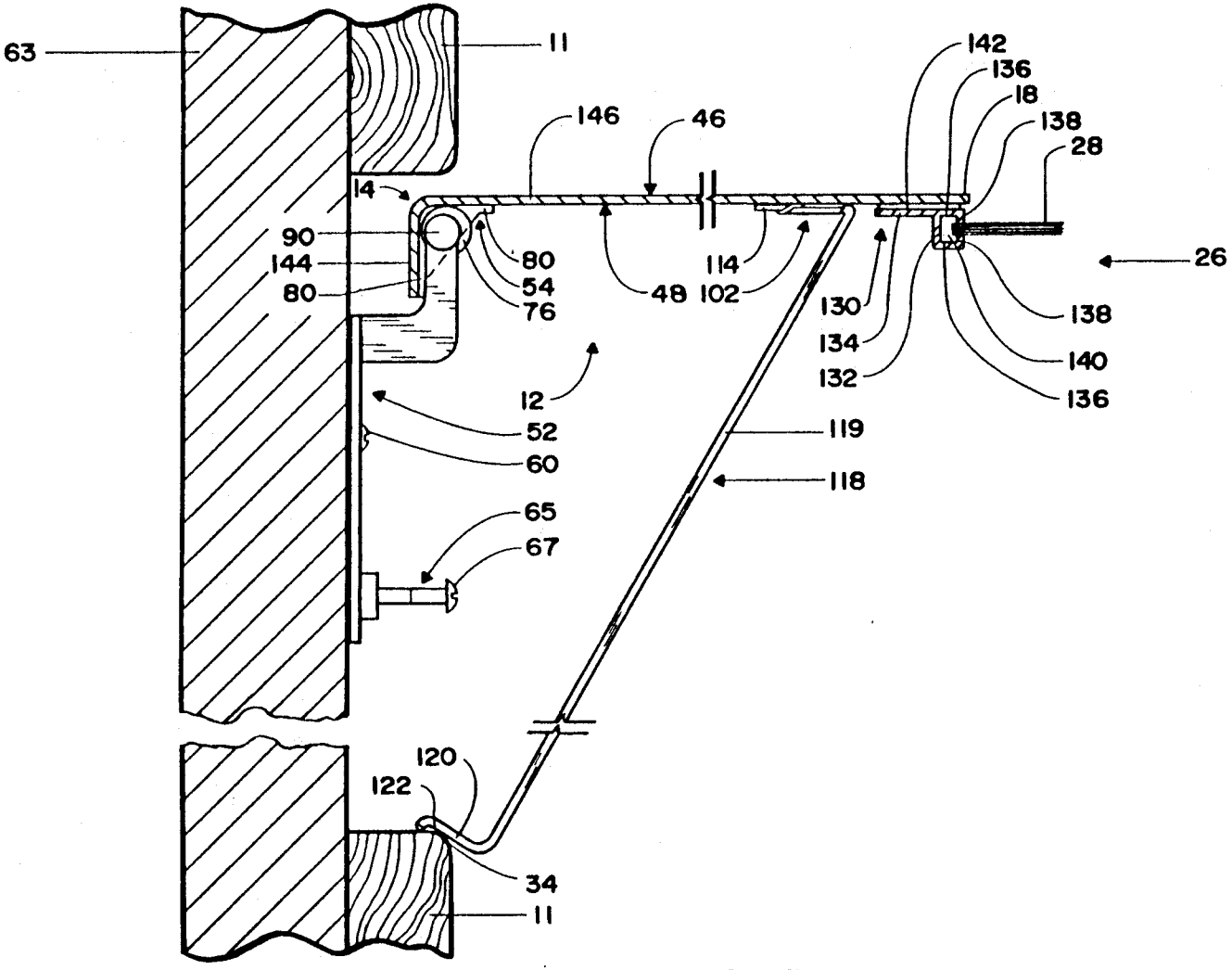
FIG. 5 is a sectional view taken along lines 5—5 of FIG. 1.

Referring to FIG. 3, the hinge 50 comprises a mounting plate 52 and a clip 54. The mounting plate 52 comprises a planar leaf 56 having a generally rectangular shape and having two holes 58 disposed therein. The holes 58 are adapted to receive fasteners 60 to secure the mounting plate 52 to a vertical support member 63 (see FIG. 5) which forms the support structure for the wall panel. Preferably, the fasteners 60 comprise conventional self-tapping screws. Alternatively, the fasteners 60 can include bolts received in holes of the wall panel support structure. Nuts can be placed on the opposite side of the wall support structure and can threadably receive the bolts. Further, as shown in FIG. 5, one or both fasteners 60 can comprise a spacer 65 adapted to receive a long screw or bolt 67. The spacer 65 acts as a stop for the hinged panel 12 when the panel is in the closed position. In such position, the backup of the panel will contact the head of the bolt 67, thus maintaining a front surface of the panel even with the adjacent panels 11.

Referring again to FIG. 3, the mounting plate 52 further includes an L-shaped member 64 extending perpendicularly from an edge 62 of the mounting plate 52. The L-shaped member 64 includes a short leg 66 integral with a long leg 68, the legs 66, 68 forming the L-shape of the L-shaped member 64. At an opposing end of the long leg 68 (opposite the short leg 66), the long leg 68 ends in a round 70. The long leg 68 has an aperture 72 disposed therein adjacent the round 70.

The clip 54 includes two rectangular leg members 80 and a trapezoidal-shaped member 82 integrally mounted to both rectangular leg members 80. Referring to FIG. 5, one rectangular leg member 80 is mounted to a flange 144 of the hinged panel 12, and one rectangular leg member 80 is mounted to a segment 146 of the hinged panel 12. Further, the rectangular leg members 80 are mounted on the back surface 48 of the hinged panel 12 near the top 14. Preferably, the rectangular leg members 80 are spot welded to the hinged panel 12.

Referring again to FIG. 3, the trapezoidal-shaped member 82 includes an aperture 88. A pin 90 is used to mount the mounting plate 52 to the clip 54. The pin 90 is received through aligned apertures 72, 88, with a bearing member 76 disposed between the L-shaped member 64 and the clip 54. The bearing member 76 is preferably a washer formed of a polymer material to facilitate pivotable movement of the clip 54 relative to the mounting plate 52. The pin 90 can be a bolt with a nut threaded onto the end thereof. However, the pin 90 preferably comprises a plastic, expandable bolt which anchors itself so that once inserted through the apertures 72, 88, the mounting plate 52 cannot be separated from the clip 54 without destroying the pin 90.

Figure 4:
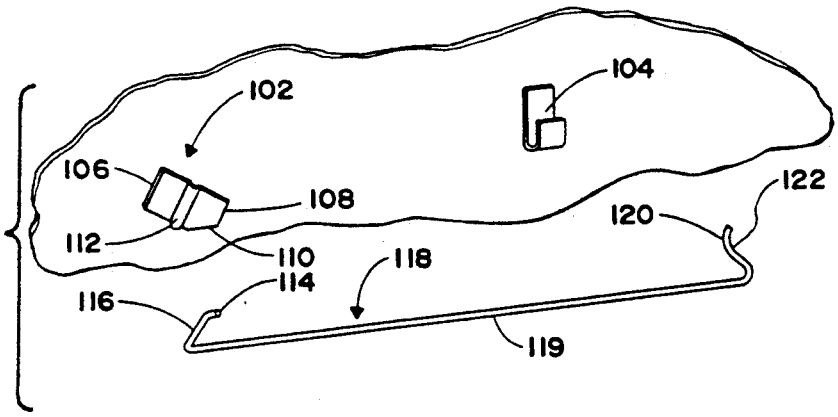
FIG. 4 is an enlarged, exploded, perspective view of a support stand assembly which forms a part of the hinged panel.

The support stand assembly 30, as shown in detail in FIG. 4, comprises a swivel bracket 102, a support stand 118 and a conventional U-shaped clip 104. The swivel bracket 102 comprises a rectangular portion 106 and a rectangular portion 108 that has a triangular cut-out. Because the rectangular portion 108 includes a triangular cut-out, a beveled edge 110 is thereby formed. The beveled edge 110 preferably extends in a direction 29° away from the horizontal edge of the rectangular portion 108. A shackle 112 is disposed between the rectangular portions 106, 108 and is integral with the rectangular portions 106, 108, thus forming a unitary structure for the swivel bracket 102.

The support stand 118 preferably comprises a long cylindrical shaft, which can be either hollow or solid. The support stand 118 includes a long, straight leg 119 having an arm 116 mounted at one end thereof. The arm 116 has a pin 114 mounted to it which extends in a substantially perpendicular direction away from the arm 116. The opposite end of the leg 119 includes a pedestal 120 having an indentation 122 therein. The arm 116 of the support stand 118 is rotatably mounted within the shackle 112 of the swivel bracket 102. The support stand 118 can be rotated roughly 90° so that the pedestal 120 of the support stand 118 extends away from the back surface 48 of the hinged panel 12 and the leg 119 is perpendicular to the back surface 48.

Referring to FIG. 5, the support stand 118 can only be rotated roughly 90° because the pin 114 acts as a stop and abuts the back surface 48 of the hinged panel 12 after the support stand 118 has been rotated roughly 90°. As shown in FIGS. 2 and 4, the leg 119 of the support stand 118 can be retained within the U-shaped clip 104. The support stand 118 preferably is formed of a ten gauge steel wire material.

Referring to FIG. 5, the brush 26 includes a brush holder 130. The brush holder 130 has the same cross-sectional shape as a chair. In other words, the brush holder 130 includes a seat 132 and a back 134 mounted to the seat 132 and extending away from the seat 132 in a perpendicular direction. The brush holder 130 also includes two legs 136 mounted to the seat 132 and also extending in a direction perpendicular to the plane of the seat 132 but extending in an opposite direction and away from the back 134. The legs 136 include flanges 138 which extend inwardly toward each other. Thus, the seat 132, the legs 136 and the flanges 138 of the brush holder 130 form a U-shaped channel 140 which is adapted to receive the bristles 28 of the brush 26. The brush 26 further includes double sided adhesive tape 142 to mount the brush holder 130 to the hinged panel 12 near the bottom 18.

FIG. 5 also illustrates the shape of the top 14 of the hinged panel 12. As can easily be seen, the top 14 includes the flange 144 which extends rearwardly (away from the top surface 46 of the hinged panel 12) in a direction perpendicular to the segment 146 of the hinged panel 12.

In operation, the hinged panel 12 according to the present invention can rest in two positions, the open position as shown in FIG. 1 or the closed position (not shown) wherein the top surface 46 (FIG. of the hinged panel 12 is generally flush with surfaces 15 (FIG. 1) of the decorative wall panels 11. If one desires to gain access to telecommunications cabling or electrical cabling in the wire management channel 23, the hinged panel 12 can be manually opened so that the bottom 18 of the hinged panel 12 moves away from the decorative wall panel 11 disposed below the hinged panel 12. Such movement of the hinged panel 12 takes place because the clip 54 rotates relative to the mounting plate 52 about a longitudinal axis of the bolt 90.

Once the hinged panel 12 is manually opened, the support stand 118 can be manually released from the U-shaped clip 104, the support stand 118 rotated about 90° so that the pedestal 120 of the support stand 118 is adjacent an upper and outermost ledge 34 of the decorative wall panel 11 disposed below the hinged panel 12. The support stand 118 should be positioned so that the indentation 122 of the support stand 118 rests against the ledge 34 of the decorative wall panel 11 disposed below the hinged panel 12.

The hinged panel 12 can be lowered to a closed position by slightly raising the bottom 18 of the hinged panel 12 and then rotating the pedestal 120 of the support stand 118 back to its original position adjacent the back surface 48 of the hinged panel 12 and placing the leg 119 of the support stand 118 within the U-shaped clip 104. The hinged panel 12 can then be manually lowered to its closed position.

When the hinged panel 12 is in its closed position, the bristles 28 preferably extend to a point such that they are flush with a top surface 32 (FIG. 1) of the decorative wall panel 11 disposed below the hinged panel 12. Electrical wiring or telecommunications cabling can extend from the wire management channel 23, through the bristles 28 of the brush 26, and outside of the wall panel structure. For example, as shown in FIG. 1, a telephone 150 can be placed on a desk 152 such that a telephone cord 154 attached to the telephone 150 can extend through the bristles 28 of the brush 26 and into the wire management channel 23.

The wipers 24 of the hinged panel 12 conceal wiring or cabling which passes from one wall panel structure to an adjacent wall panel structure. Typically, the wiper of the first wall panel structure will slightly overlap the wiper of the adjacent wall panel structure so that any wiring or cabling which passes from one wall panel structure to the adjacent wall panel structure cannot be seen.

The hinged panel 12 according to the present invention is preferably used as a wire management panel to conceal and provide ready access to telecommunications cabling, electrical wiring, or electrical receptacles in the wire management channel 23. The hinged panel 12 of the present invention is advantageous because it can be supported in the open position by the support stand 118 when one needs to gain access to the wire management channel 23.

Reasonable variation and modification are possible within the spirit of the foregoing specification and drawings without departing from the scope of the invention. For example, the hinged panel 12 need not include openings 22 for electrical outlets, and the hinged panel 12 could include more than two openings 22 for electrical outlets or for other purposes. Further-more, the support stand 118 need not be shaped exactly as shown in the accompanying drawings since it is clearly contemplated that other support stands could be used which would accomplish the same function of the support stand 118 in substantially the same manner.

The embodiments of the invention in which an exclusive property or privilege is claimed are defined as follows:

1. A panel for covering a wire raceway in a modular wall structure, said panel comprising:

a front surface, a back surface opposing the front surface, a first edge, a second edge, and opposite side edges extending therebetween;

a hinge mounted on the back surface adjacent the first edge for hingedly mounting the panel to the wall structure for movement of the panel between a closed position where the back surface encloses the wire raceway, and an open position where the wire raceway is exposed; and a support member pivotably mounted to the back surface for movement between a retained position and an engaging position, said support member having a pedestal adapted to engage a ledge of the wall structure to maintain the panel in the open position when the support member is in the engaging position.

2. A panel according to claim 1 further comprising a bracket on the back surface away from the first edge, the support member being pivotably mounted to the bracket.

3. A panel according to claim 2 wherein the support member comprises an elongated shaft having an arm extending therefrom at a predetermined angle, the bracket has a shackle disposed at the same predetermined angle relative to the second edge, and the arm is received in the shackle.

4. A panel according to claim 1 wherein the pedestal has an indentation which is adapted to engage a ledge of the wall structure when the support member is in the engaging position.

5. A panel according to claim 1 further comprising a retaining clip on the back surface adapted to receive and maintain the support member in the retaining position.

6. A panel according to claim 1 further comprising a stop to limit movement pivotal of the support member beyond the engaging position.

7. A panel according to claim 6 wherein the stop is a pin extending from the support member and adapted to abut the back surface when the support member is in the engaging position.

8. In a modular office divider system comprising a partition having vertical edges, a wire raceway extending horizontally between the edges, and a panel pivotably mounted to the partition for movement between a closed position enclosing the wire raceway, and an open position exposing the wire raceway, the improvement in the panel comprising:

a prop mounted to the panel, said prop being adapted to maintain the panel in the open position;

said prop comprising a support member pivotably mounted to the panel for movement between a retained position and an engaging position, said support member having a pedestal adapted to engage a ledge of the partition to maintain the panel in the open position when the support member is in the engaging position.

9. The improvement according to claim 8 further comprising a bracket on the back surface away from the first edge, the support member being pivotably mounted to the bracket.

10. The improvement according to claim 9 wherein the support member comprises an elongated shaft having an arm extending therefrom at a predetermined angle, the bracket has a shackle disposed at the same predetermined angle relative to the second edge, and the arm is received in the shackle.

11. The improvement according to claim 8 wherein the pedestal has an indentation which is adapted to engage a ledge of the partition when the support member is in the engaging position.

12. The improvement according to claim 8 further comprising a retaining clip on the surface adapted to receive and maintain the support member in the retaining position.

13. The improvement according to claim 8 further comprising a stop to limit movement of the support member beyond the engaging position.

14. The improvement according to claim 13 wherein the stop is a pin extending from the support member and adapted to abut the back surface when the support member is in the engaging position.

15. The improvement according to claim 8 wherein the panel comprises a flange extending perpendicularly from an adjacent surface, and is mounted to the partition by a hinge, said hinge comprising:

a mounting plate securely fixed to the partition;

an L-shaped member extending perpendicularly from the mounting plate, said L-shaped member having a first aperture;

a clip having two spaced legs and a web connecting the legs, said web having nonparallel sides, and said legs extending substantially perpendicularly from the nonparallel sides, one of said legs being securely mounted to the flange, and the other of said legs being securely mounted to the adjacent surface, said web having a second aperture;

said first aperture and said second aperture being in registry; and a pin extending through said first and second apertures, whereby the panel can be pivoted relative to the partition about the pin.

* * * * *